US010553154B2

(12) United States Patent
Li et al.

(10) Patent No.: US 10,553,154 B2
(45) Date of Patent: Feb. 4, 2020

(54) METHOD AND APPARATUS FOR DETECTING DRIVING CIRCUIT

(71) Applicant: BOE Technology Group Co., Ltd., Beijing (CN)

(72) Inventors: Yongqian Li, Beijing (CN); Pan Xu, Beijing (CN); Zhidong Yuan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 100 days.

(21) Appl. No.: 15/744,381

(22) PCT Filed: Jun. 30, 2017

(86) PCT No.: PCT/CN2017/091109
§ 371 (c)(1),
(2) Date: Jan. 12, 2018

(87) PCT Pub. No.: WO2018/095036
PCT Pub. Date: May 31, 2018

(65) Prior Publication Data

US 2018/0374405 A1 Dec. 27, 2018

(30) Foreign Application Priority Data

Nov. 24, 2016 (CN) ..... 2016 1 1049648

(51) Int. Cl.
*G09G 3/3233* (2016.01)
*G09G 3/00* (2006.01)
*G09G 3/3266* (2016.01)

(52) U.S. Cl.
CPC ..... *G09G 3/3233* (2013.01); *G09G 3/006* (2013.01); *G09G 3/3266* (2013.01); *G09G 2320/043* (2013.01); *G09G 2330/12* (2013.01)

(58) Field of Classification Search
CPC ..... G09G 3/3233; G09G 2320/0295; G09G 3/3291; G09G 2320/0233; G09G 3/006;
(Continued)

(56) References Cited

U.S. PATENT DOCUMENTS

2004/0008053 A1* 1/2004 Nara ..... G09G 3/006 324/760.02
2004/0056604 A1 3/2004 Shih et al.
(Continued)

FOREIGN PATENT DOCUMENTS

CN 102708819 A 10/2012
CN 103021331 A 4/2013
(Continued)

OTHER PUBLICATIONS

Sep. 30, 2017—(WO) International Search Report and Written Opinion Appn PCT/CN2017/091109 with English Tran.
(Continued)

*Primary Examiner* — Sanjiv D. Patel
(74) *Attorney, Agent, or Firm* — Banner & Witcoff, Ltd.

(57) ABSTRACT

A method and an apparatus for detecting a driving circuit. The method includes: inputting a data signal, a gate line scanning signal, a voltage signal, and a first control signal with a first voltage level into a data input end, a gate scanning input end, a power source end and a voltage sensing end of the driving circuit, respectively; by inputting a second control signal with a second voltage level into a sensing-scanning input end, controlling a pixel storage capacitor to be charged, and measuring a first voltage of an OLED anode end; by inputting the second control signal with a third voltage level to the sensing-scanning input end, controlling the pixel storage capacitor to be discharged, and measuring a second voltage of the OLED anode end; and
(Continued)

determining whether the driving circuit has abnormity or not according to the first voltage and the second voltage.

18 Claims, 3 Drawing Sheets

(58) Field of Classification Search
CPC ..... G09G 2320/029; G09G 3/3258; G09G 2300/0876; G09G 2330/10
See application file for complete search history.

(56) References Cited

U.S. PATENT DOCUMENTS

| | | | | |
|---|---|---|---|---|
| 2007/0026930 | A1 | 2/2007 | Frost et al. | |
| 2008/0088547 | A1 | 4/2008 | Chan et al. | |
| 2010/0073357 | A1* | 3/2010 | Min | G09G 3/3233 345/214 |
| 2011/0279484 | A1* | 11/2011 | Han | G09G 3/3233 345/690 |
| 2012/0105501 | A1 | 5/2012 | Nakamura et al. | |
| 2012/0299978 | A1* | 11/2012 | Chaji | G09G 3/3291 345/690 |
| 2013/0050292 | A1* | 2/2013 | Mizukoshi | G09G 3/3291 345/690 |
| 2013/0257437 | A1* | 10/2013 | Jin | G01R 31/2635 324/414 |
| 2014/0111823 | A1 | 4/2014 | Park et al. | |
| 2014/0152191 | A1 | 6/2014 | Yang et al. | |
| 2016/0086544 | A1* | 3/2016 | Park | G09G 3/3233 345/690 |
| 2016/0098961 | A1* | 4/2016 | Han | G09G 3/3291 345/691 |
| 2016/0163261 | A1 | 6/2016 | Kim et al. | |
| 2016/0247450 | A1 | 8/2016 | Liu et al. | |
| 2017/0162125 | A1 | 6/2017 | Liang | |

FOREIGN PATENT DOCUMENTS

| | | | |
|---|---|---|---|
| CN | 104835469 | A | 8/2015 |
| CN | 105047137 | A | 11/2015 |
| CN | 105280141 | A | 1/2016 |
| CN | 105702209 | A | 6/2016 |
| CN | 106409198 | A | 2/2017 |
| JP | 2012098317 | A | 5/2012 |

OTHER PUBLICATIONS

Jul. 4, 2017—(CN) First Office Action Appn 201611049648.with English Tran.

* cited by examiner

METHOD AND APPARATUS FOR DETECTING DRIVING CIRCUIT

The application is a U.S. National Phase Entry of International Application No. PCT/CN2017/091109 filed on Jun. 30, 2017, designating the United States of America and claiming priority to Chinese Patent Application No. 201611049648.3 filed on Nov. 24, 2016. The present application claims priority to and the benefit of the above-identified applications and the above-identified applications are incorporated by reference herein in their entirety.

TECHNICAL FIELD

Embodiments of the present disclosure relate to a method and an apparatus for detecting a driving circuit.

BACKGROUND

An Active-Matrix Organic Light Emitting Diode (AMOLED) display screen comprises an array substrate and other parts. For example, the array substrate includes a plurality of pixel units, and each pixel unit corresponds to one driving circuit. The driving circuit is used for driving a pixel unit corresponding to the driving circuit to emit light.

When the array substrate is produced, the driving circuit can be generated on a glass substrate by a patterning process. The pixel unit corresponding to the driving circuit and other portions included by the array substrate continue to be manufactured on the glass substrate by patterning processes, and the other portions can include a light filtering layer, a black matrix and the like.

In existing technologies, a process of generating driving circuits is difficult, which leads to abnormality of the generated driving circuits in some cases. If the other portions of the array substrate continue to be generated on a basis of the abnormal driving circuits, product defects are likely to occur, resulting in a relatively high production cost.

SUMMARY

Embodiments of the disclosure provide a method for detecting a driving circuit, comprising:

inputting a data signal, a gate line scanning signal, a voltage signal, and a first control signal with a first voltage level into a data input end, a gate scanning input end, a power source end and a voltage sensing end of the driving circuit, respectively;

by inputting a second control signal with a second voltage level into a sensing-scanning input end of the driving circuit, controlling a pixel storage capacitor of the driving circuit to be charged, and measuring a first voltage of an organic light emitting diode (OLED) anode end of the driving circuit;

by inputting the second control signal with a third voltage level to the sensing-scanning input end, controlling the pixel storage capacitor to be discharged, and measuring a second voltage of the OLED anode end of the driving circuit; and determining whether the driving circuit has abnormity or not according to the first voltage and the second voltage.

For example, by inputting the second control signal with the second voltage level into the sensing-scanning input end of the driving circuit, controlling the pixel storage capacitor of the driving circuit to be charged, includes:

by inputting the second control signal with the second voltage level into the sensing-scanning input end of the driving circuit, controlling the pixel storage capacitor of the driving circuit to be connected to the voltage sensing end to make the pixel storage capacitor be charged.

For example, by inputting the second control signal with the third voltage level into the sensing-scanning input end, controlling the pixel storage capacitor to be discharged, includes:

by the inputting the second control signal with the third voltage level into the sensing-scanning input end, controlling the pixel storage capacitor to be disconnected from the voltage sensing end so as to make the pixel storage capacitor be discharged.

For example, the pixel storage capacitor is controlled to be charged at a charging stage, the pixel storage capacitor is controlled to be discharged at a discharging stage, the charging stage and the discharging stage are two continuous time periods, and the charging stage is before the discharging stage.

For example, a duration of the charging stage is greater than that of the discharging stage.

For example, inputting the first control signal with the first voltage level to the voltage sensing end of the driving circuit, includes:

inputting the first control signal with the first voltage level to the voltage sensing end of the driving circuit at the charging stage and the discharging stage; or inputting the first control signal with the first voltage level to the voltage sensing end of the driving circuit at the charging stage.

For example, the first voltage level and the second voltage level are both greater than the third voltage level.

For example, the first voltage level is less than the second voltage level.

For example, determining whether the driving circuit has abnormity or not according to the first voltage and the second voltage, includes:

calculating a voltage difference between the first voltage and the second voltage; and if the voltage difference is within a preset numerical value range, determining that the driving circuit does not have abnormity, otherwise, determining that the driving circuit has abnormity.

For example, inputting the gate line scanning signal into the gate scanning input end of the driving circuit, includes:

by inputting the gate line scanning signal into the gate scanning input end of the driving circuit, controlling the pixel storage capacitor to be connected to the data input end, and disconnecting the power source end from the OLED anode end.

For example, a voltage value of the data signal is less than that of the gate line scanning signal.

For example, a voltage value of the voltage signal is greater than or equal to 0V and less than or equal to 15V.

Embodiments of the disclosure further provide an apparatus for detecting a driving circuit, comprising:

an input circuit, configured to respectively input a data signal, a gate line scanning signal, a voltage signal and a first control signal with a first voltage level into a data input end, a gate scanning input end, a power source end and a voltage sensing end of the driving circuit;

a control circuit, configured to: by inputting a second control signal with a second voltage level into a sensing-scanning input end of the driving circuit through the input circuit, control a pixel storage capacitor of the driving circuit to be charged, and measure a first voltage of an organic light emitting diode (OLED) anode end of the driving circuit; and by inputting the second control signal with a third voltage level to the sensing-scanning input end through the input circuit, control the pixel storage capacitor to be discharged, and measure a second voltage of the OLED anode end of the driving circuit; and a judgment circuit, configured to determine whether the driving circuit has abnormity or not according to the first voltage and the second voltage.

For example, the control circuit controls the pixel storage capacitor of the driving circuit to be charged by inputting the second control signal with the second voltage level into the sensing-scanning input end of the driving circuit through the input signal, including:

by inputting the second control signal with the second voltage level into the sensing-scanning input end of the driving circuit through the input circuit, controlling the pixel storage capacitor to be connected to the voltage sensing end to make the pixel storage capacitor be charged.

For example, the control circuit controls the pixel storage capacitor to be discharged by inputting the second control signal with the third voltage level into the sensing-scanning input end through the input signal, including:

by inputting the second control signal with the third voltage level into the sensing-scanning input end through the input circuit, controlling the pixel storage capacitor to be disconnected from the voltage sensing end so as to make the pixel storage capacitor be discharged.

For example, the control circuit is configured to control the pixel storage capacitor to be charged at a charging stage, and to control the pixel storage capacitor to be discharged at a discharging stage, the charging stage and the discharging stage are two continuous time periods, and the charging stage is before the discharging stage.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

DETAILED DESCRIPTION

Hereafter, the technical solutions of the embodiments of the present disclosure will be described in a clearly and fully understandable way in connection with the drawings related to the embodiments of the disclosure. It is obvious that the described embodiments are just a part but not all of the embodiments of the present disclosure. Based on embodiments of the present disclosure, all other embodiments obtained by those skilled in the art without making other inventive work should be within the scope of the present disclosure.

According to an embodiment of the present disclosure, when a pixel storage capacitor Cst is controlled to be charged, a first voltage V1 of an anode end ITO of an OLED is measured, and when the pixel storage capacitor Cst is controlled to be discharged, a second voltage V2 of the anode end ITO of the OLED is measured; then it is determined whether the pixel storage capacitor Cst is abnormal or not according to the first voltage V1 and the second voltage V2; and if abnormity exists, continuous production of a pixel unit corresponding to a driving circuit and other parts terminates, and a manufacturing cost is reduced.

Figure 1A:
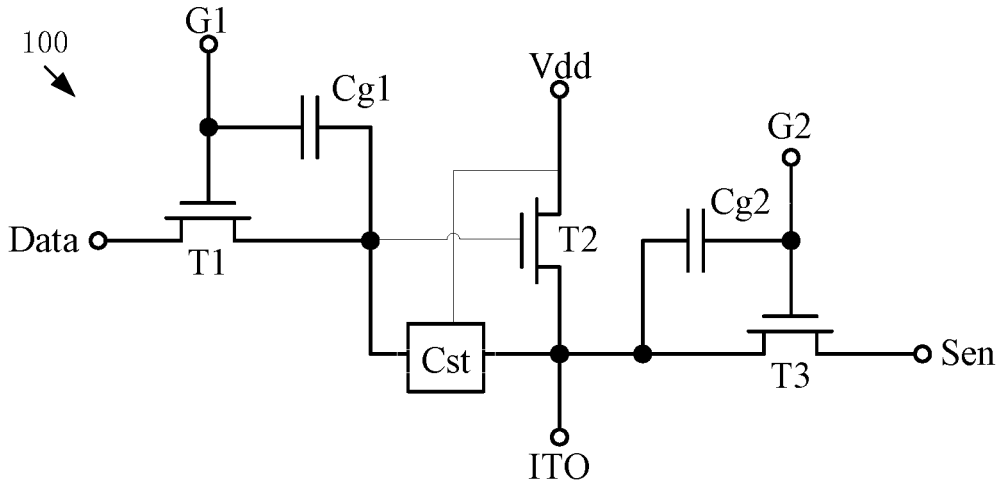
FIG. 1A is a structural schematic diagram of a driving circuit provided by an embodiment of the present disclosure.

An embodiment of the present disclosure provides a driving circuit, and the driving circuit is located on an array substrate. On the array substrate, a pixel unit corresponding to the driving circuit is further included, and the driving circuit is used for driving the pixel unit corresponding to the driving circuit to emit light. Referring to FIG. 1A, the driving circuit 100 comprises:

a first transistor T1, a second transistor T2, a third transistor T3, a pixel storage capacitor Cst, a first parasitic capacitor Cg1 and a second parasitic capacitor Cg2;

a gate electrode of the first transistor T1 is connected with a gate scanning input end G1, a first electrode of the first transistor T1 is connected with a data input end Data, and a second electrode of the first transistor T1 is connected with a gate electrode of the second transistor T2, a first metal layer of the pixel storage capacitor Cst and a first end of the first parasitic capacitor Cg1;

a first electrode of the second transistor T2 is connected with a power source end Vdd, and a second electrode of the second transistor T2 is connected with an OLED anode layer of the pixel storage capacitor Cst, a first end of the second parasitic capacitor Cg2, a first electrode of the third transistor T3 and an OLED anode end ITO; and a second end of the first parasitic capacitor Cg1 is connected with the gate scanning input end G1, a second end of the second parasitic capacitor Cg2 is connected with a sensing-scanning input end G2, a second metal layer of the pixel storage capacitor Cst is connected with the power source end Vdd, a gate electrode of the third transistor T3 is connected with the sensing-scanning input end G2, and a second electrode of the third transistor T3 is connected with a voltage sensing end Sen.

The data input end Data and the voltage sensing end Sen of the driving circuit are respectively connected with two data lines on the array substrate; the gate scanning input end G1 and the sensing-scanning input end G2 are respectively connected with two gate lines on the array substrate; and the power source end Vdd is connected with a power source line on the array substrate.

Figure 1B:
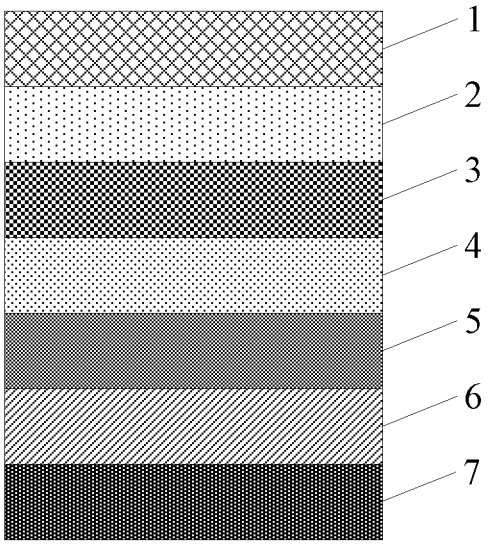
FIG. 1B is a structural schematic diagram of a pixel storage capacitor provided by an embodiment of the present disclosure.

Referring to a structure of the pixel storage capacitor Cst as shown in FIG. 1B, the pixel storage capacitor Cst includes an OLED anode layer 1, a first protective layer 2, a first metal layer 3, a second protective layer 4, an active layer 5, a third protective layer 6 and a second metal layer 7.

The pixel storage capacitor Cst is stacked according to a sequence of the OLED anode layer 1, the first protective layer 2, the first metal layer 3, the second protective layer 4, the active layer 5, the third protective layer 6 and the second metal layer 7.

The OLED anode layer 1 is of a conductor structure, and the OLED anode layer 1, the first protective layer 2 and the first metal layer 3 form a first capacitor.

The OLED anode layer 1 is connected with the active layer 5, where the active layer 5 includes a substrate and a semiconductor material layer deposited on the substrate, and the semiconductor material layer is close to the second protective layer 4. When a high voltage signal with a voltage value greater than 0 is input to the second metal layer 7 from the power source end Vdd, the semiconductor material layer is conductorized, and at this moment, the active layer 5, the second protective layer 4 and the first metal layer 3 form a second capacitor. Because the active layer 5 is connected with the OLED anode layer 1, the first capacitor and the second capacitor are connected in parallel, and a capacitance value of the pixel storage capacitor Cst is determined by a capacitance value of the first capacitor and a capacitance value of the second capacitor.

A semiconductor material can be indium gallium zinc oxide (IGZO). The semiconductor material is deposited on the substrate to form the semiconductor material layer. Because a difficulty of a deposition process is relatively large, an active layer 5 produced each time is different, and a capacitance value of the pixel storage capacitor Cst formed in this way is different along with the different active layer 5. When a capacitance value of the produced pixel storage capacitor Cst goes beyond a preset normal capacitance value range, abnormity of the driving circuit occurs. In embodiments of the present disclosure, an abnormal driving circuit is detected through the following embodiments, and therefore production of the other portions of the array substrate terminates on the basis of the abnormal driving circuit, and a production cost is reduced.

An embodiment of the present disclosure provides a method for detecting a driving circuit, and the method is used for detecting the driving circuit as mentioned above.

Figure 2A:
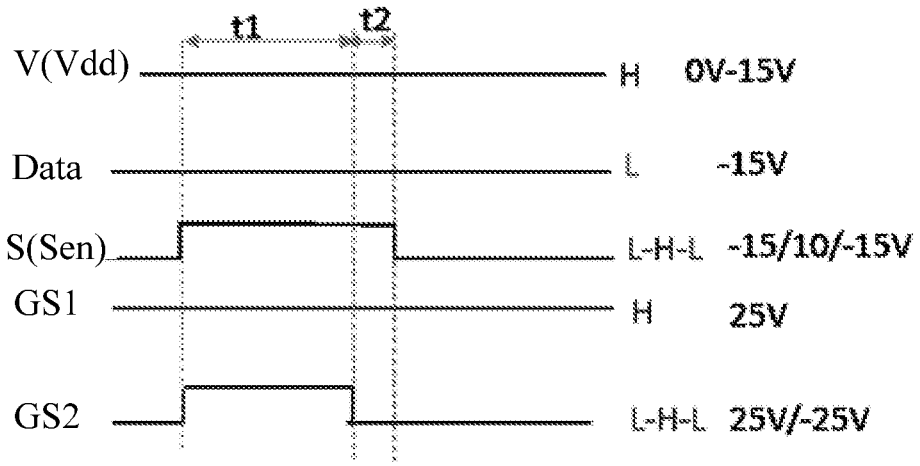
FIG. 2A is a timing signal diagram provided by an embodiment of the present disclosure.

Referring to the timing signal diagram as shown in FIG. 2A, the embodiment of the present disclosure provides a data signal Data, a gate line scanning signal GS1, a voltage signal V, a first control signal S and a second control signal GS2; at a charging stage t1 and a discharging stage t2, the driving circuit is detected through the data signal Data, the gate line scanning signal GS1, the voltage signal V, the first control signal S and the second control signal GS2.

Figure 2B:
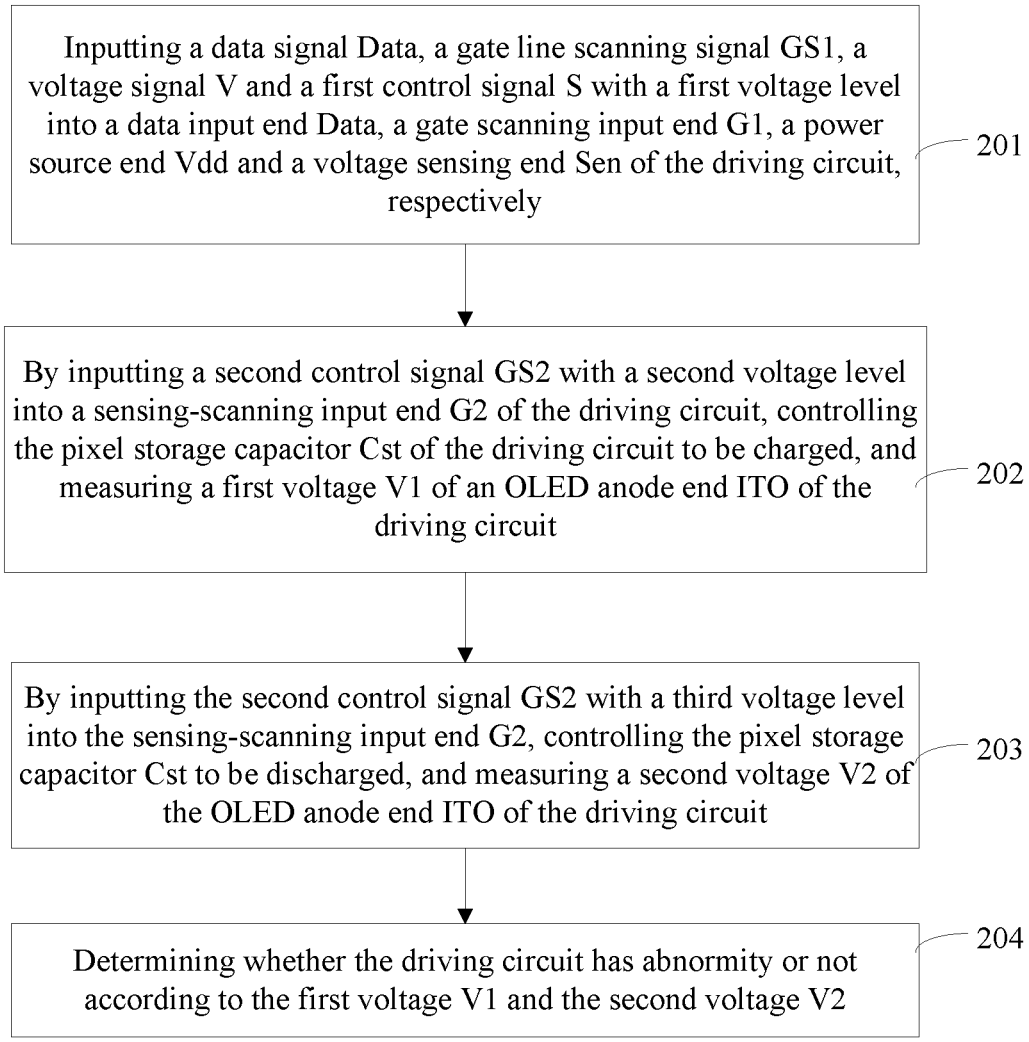
FIG. 2B is a flow diagram of a method for detecting a driving circuit provided by an embodiment of the present disclosure.

Referring to FIG. 2B, the method for detecting the driving circuit comprises:

Step 201: inputting the data signal Data, the gate line scanning signal GS1, the voltage signal V and the first control signal S with a first voltage level into a data input end Data, a gate scanning input end G1, a power source end Vdd and a voltage sensing end Sen of the driving circuit, respectively.

Referring to FIG. 2A, the data signal Data, the gate line scanning signal GS1 and the voltage signal V each are a voltage signal with a constant voltage value. A voltage value of the data signal Data (−15V in FIG. 2A) is less than a voltage value of the gate line scanning signal GS1 (25V in FIG. 2A) and a voltage value of the voltage signal V (0V-15V in FIG. 2A).

The data signal Data can be input into a data line of the array substrate that is connected with the data input end Data, so that the data signal Data can be input into the data input end Data; the gate line scanning signal GS1 can be input into a gate line of the array substrate that is connected with the gate scanning input end G1, so that the gate line scanning signal GS1 can be input into the gate scanning input end G1; the voltage signal V can be input into a power source line of the array substrate that is connected with the power source end Vdd, so that the voltage signal V can be input into the power source end Vdd; and the first control signal S with the first voltage level can be input into a data line of the array substrate that is connected with the voltage sensing end Sen, so that the first control signal S with the first voltage level can be input into the voltage sensing end Sen.

A voltage value of the gate line scanning signal GS1 can be greater than 0, for example, the voltage value of the gate line scanning signal GS1 can be 25V or 20V or the like. A voltage value of the voltage signal V can be greater than or equal to 0V and is less than or equal to 15V. A voltage value of the data signal Data can be less than 0V, and for example, can be −15V or −10V or the like.

The first voltage level is greater than 0V, and for example can be 10V or 8V or the like. At the charging stage t1 and the discharging stage t2, the first control signal S with the first voltage level is input into the voltage sensing end Sen, and in other time periods, the first control signal S with a voltage value less than 0V is input into the voltage sensing end Sen; or, the first control signal S with the first voltage level is input into the voltage sensing end Sen only at the charging stage t1, and in other time periods, the first control signal S with a voltage value less than 0V is input into the voltage sensing end Sen. In the other time periods, the voltage value of the first control signal S input into the voltage sensing end Sen can be −15V or −10V or the like.

Referring to FIG. 2A, the charging stage t1 and the discharging stage t2 are two continuous time periods, and the charging stage t1 is before the discharging stage t2. In addition, a duration of the charging stage t1 can be greater than a duration of the discharging stage t2.

In the step S201, by inputting the gate line scanning signal GS1 into the gate scanning input end G1, the first transistor T1 is made to be turned on, and therefore the pixel storage capacitor Cst is controlled to be connected to the data input end Data, and a gate electrode of the second transistor T2 is controlled to be connected to the data input end Data; the data signal input from the data input end Data of the driving circuit is transmitted to the gate electrode of the second transistor T2 and the pixel storage capacitor Cst through the first transistor T1, so that the second transistor T2 can be controlled to be turned off, and therefore the power source end Vdd of the driving circuit is disconnected from the OLED anode end ITO.

Step S202: by inputting a second control signal GS2 with a second voltage level into a sensing-scanning input end G2 of the driving circuit, controlling the pixel storage capacitor Cst of the driving circuit to be charged, and measuring a first voltage V1 of the OLED anode end ITO of the driving circuit.

The second control signal GS2 with the second voltage level can be input into a gate line of the array substrate connected with the sensing-scanning input end G2, so that the second control signal GS2 with the second voltage level can be input into the sensing-scanning input end G2.

Referring to FIG. 2B, the second voltage level is greater than the first voltage level, and for example, the second voltage level can be 25V or 20V or the like. At the charging stage t1, the second control signal GS2 with the second voltage level is input into the sensing-scanning input end G2 to make the third transistor T3 to be turned on, and therefore the pixel storage capacitor Cst can be controlled to be connected to the voltage sensing end Sen; the first control signal S with the first voltage level input from the voltage sensing end Sen of the driving circuit is transmitted to the pixel storage capacitor Cst through the third transistor T3 to make the pixel storage capacitor Cst be charged, and meanwhile the first voltage V1 of the OLED anode end ITO is measured through a measuring device.

Step 203: by inputting the second control signal GS2 with a third voltage level into the sensing-scanning input end G2, controlling the pixel storage capacitor Cst to be discharged, and measuring a second voltage V2 of the OLED anode end ITO of the driving circuit.

Because the third voltage level is less than 0V, and for example can be −25V or −20V or the like, the third transistor T3 is made to be turned off, and therefore the pixel storage capacitor Cst can be disconnected from the voltage sensing end Sen; and at this moment, the pixel storage capacitor Cst and the second parasitic capacitor Cg2 are connected in series, the second parasitic capacitor Cg2 has a coupling voltage-dividing effect on the pixel storage capacitor Cst to make the pixel storage capacitor Cst be discharged, and meanwhile the second voltage V2 of the OLED anode end ITO of the driving circuit is measured through the measuring device.

Step 204: determining whether the driving circuit has abnormity or not according to the first voltage V1 and the second voltage V2.

The step 204 can include that: a voltage difference between the first voltage V1 and the second voltage V2 is calculated; if the voltage difference is within a preset numerical value range, it is determined that the driving circuit does not have abnormity, otherwise, it is determined that the driving circuit has abnormity.

For example, the voltage difference ΔVp on the OLED anode end ITO of the driving circuit meets a constraint relationship in the following formula (1):

$$\Delta Vp=(Vgh-Vgl)*Cgs2/(Cgs2+Cst). \quad (1)$$

In the formula (1), Cgs2 is a capacitance value of the second parasitic capacitor Cg2, Cst is a capacitance value of the pixel storage capacitor Cst, Vgh is a value of the second voltage level, Vg1 is a value of the third voltage level, and these four values are all fixed values. From the above formula (1), it can be obtained that: the voltage difference ΔVp on the OLED anode end ITO is different along with a different capacitance value of the pixel storage capacitor Cst. Thus, in this step, a normal numerical value range within which the voltage difference ΔVp on the OLED anode end ITO locates is defined in advance, namely a preset numerical value range. If it is detected that the voltage difference ΔVp on the OLED anode end ITO is not within the preset numerical value range, it shows that the capacitance value of the pixel storage capacitor Cst is not within a preset normal capacitance value range, and the capacitance value of the pixel storage capacitor Cst may be too large or too small, thereby resulting in abnormity of the driving circuit.

If the driving circuit has abnormity, a manufactured display screen has dark spots. In order to further prove that the dark spots of the display screen are caused by an active layer 5 in the pixel storage capacitor Cst, a voltage value of the voltage signal V input into the power source end Vdd can be gradually changed to be 0V, and the dark spots will disappear gradually. Detailed analysis is as follows:

Referring to FIG. 1B, the pixel storage capacitor Cst is formed by two capacitors in a combined manner, with one being a first capacitor formed by an OLED anode layer 1, a first protective layer 2 and a first metal layer 3, and another being a second capacitor formed by a first metal layer 3, a second protective layer 4 and the active layer 5. A conductorization degree of the active layer 5 is affected by a value of the voltage signal V on the second metal layer 7; when the voltage signal V on the second metal layer 7 is greater, the conductorization degree of the active layer 5 is higher, and influence of the formed second capacitor on the capacitance value of the pixel storage capacitor Cst is greater; on the contrary, when the voltage signal V on the second metal layer 7 is smaller, the conductorization degree of the active layer 5 is lower, and the influence of the formed second capacitor on the capacitance value of the pixel storage capacitor Cst is smaller. Thus, when the voltage value of the voltage signal V input into the second metal layer 7 from the power source end Vdd is smaller, the capacitance value of the pixel storage capacitor Cst is more approaching a capacitance value of the first capacitor, influence on the voltage difference ΔVp on the OLED anode end ITO is smaller, and therefore the dark spots on the display screen are less.

Figure 3:
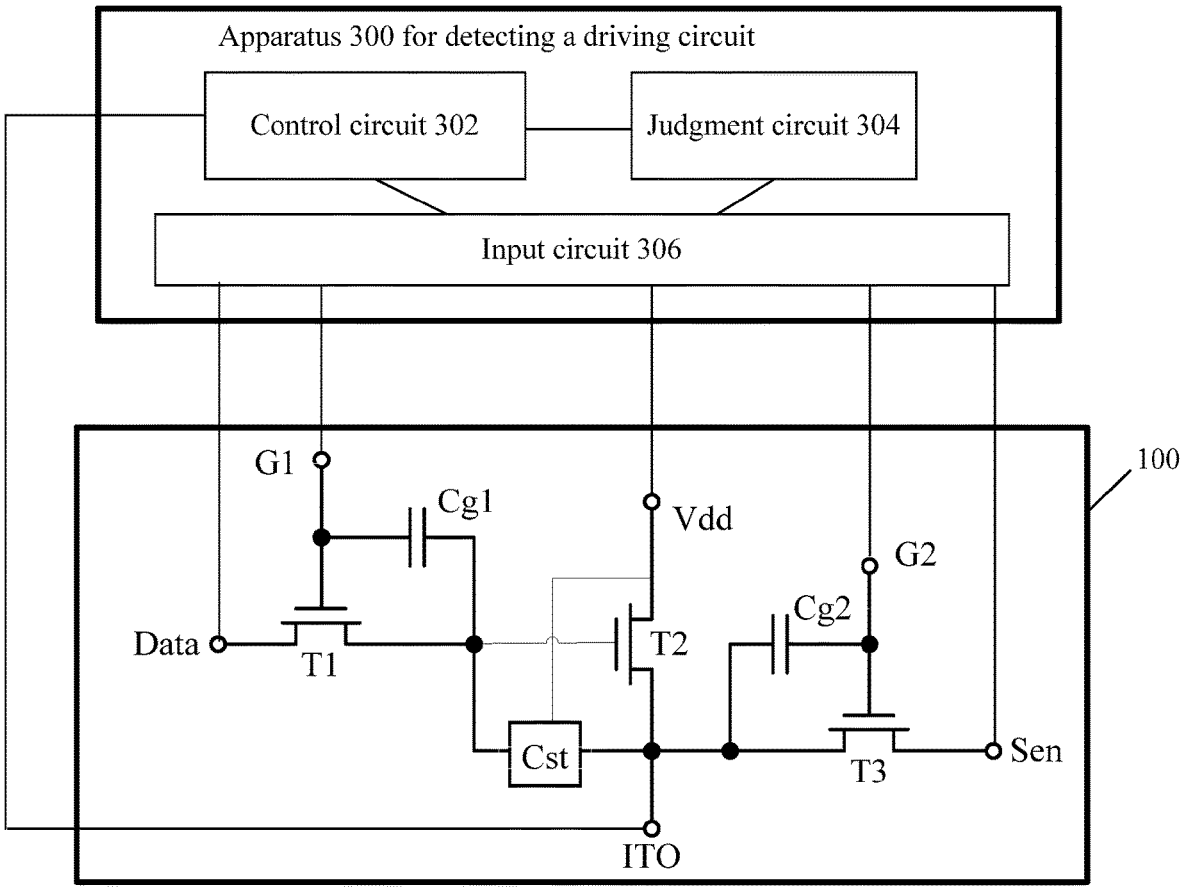
FIG. 3 is an apparatus for detecting a driving circuit provided by an embodiment of the present disclosure.

As shown in FIG. 3, an embodiment of the present disclosure further provides an apparatus 300 for detecting a driving circuit, comprising:

an input circuit 306, configured to respectively input a data signal, a gate line scanning signal, a voltage signal and a first control signal with a first voltage level into a data input end, a gate scanning input end, a power source end and a voltage sensing end of the driving circuit 100;

a control circuit 302, configured to: by inputting a second control signal with a second voltage level into a sensing-scanning input end of the driving circuit through the input circuit 306, control a pixel storage capacitor of the driving circuit 100 to be charged and measure a first voltage of an anode end of an organic light emitting diode (OLED) of the driving circuit 100; and by inputting a second control signal with a third voltage level into the sensing-scanning input end through the input circuit 306, control the pixel storage capacitor to be discharged, and measure a second voltage of the anode end of the OLED of the driving circuit; and a judgment circuit 306, configured to determine whether the driving circuit 100 has abnormity or not according to the first voltage and the second voltage.

For example, the control circuit 302 controls the pixel storage capacitor of the driving circuit to be charged by inputting the second control signal with the second voltage level into the sensing-scanning input end of the driving circuit 100 through the input circuit 306, including:

by inputting the second control signal with the second voltage level into the sensing-scanning input end of the driving circuit 100 through the input circuit 306, controlling the pixel storage capacitor to be connected to the voltage sensing end to make the pixel storage capacitor be charged.

For example, the control circuit 302 controls the pixel storage capacitor to be discharged by inputting the second control signal with the third voltage level into the sensing-scanning input end through the input circuit 306, including:

by inputting the second control signal with the third voltage level into the sensing-scanning input end through the input circuit 306, controlling the pixel storage capacitor to be disconnected from the voltage sensing end so as to make the pixel storage capacitor be discharged.

For example, the control circuit 302 is configured to control the pixel storage capacitor to be charged at the charging stage, and to control the pixel storage capacitor to be discharged at the discharging stage, the charging stage and the discharging stage are two continuous time periods, and the charging stage is prior to the discharging stage.

For example, a duration of the charging stage is greater than that of the discharging stage.

For example, the control circuit 302 inputs the first control signal with the first voltage level into the voltage sensing end of the driving circuit 100 through the input circuit 306, including:

inputting the first control signal with the first voltage level into the voltage sensing end of the driving circuit 100 through the input circuit at the charging stage and the discharging stage; or inputting the first control signal with the first voltage level into the voltage sensing end of the driving circuit through the input circuit at the charging stage.

For example, the first voltage level and the second voltage level are both greater than the third voltage level.

For example, the first voltage level is less than the second voltage level.

For example, the judgment circuit 304 determines whether the driving circuit has abnormity or not according to the first voltage and the second voltage, including:

calculating a voltage difference between the first voltage and the second voltage; and if the voltage difference is within a preset numerical value range, determining that the driving circuit does not have abnormity, or otherwise, determining that the driving circuit has abnormity.

For example, the control circuit 302 inputs the gate line scanning signal into the gate scanning input end of the driving circuit 100 through the input circuit 306, including:

inputting the gate line scanning signal into the gate scanning input end of the driving circuit 100 through the input circuit 306, controlling the pixel storage capacitor to be connected to the data input end, and disconnecting the power source end from the OLED anode end.

For example, a voltage value of the data signal is less than that of the gate line scanning signal.

For example, a voltage value of the voltage signal is greater than or equal to 0 and less than or equal to 15V.

For example, the input circuit 306 includes a signal generator, used for generating various signals in the embodiments of the present disclosure. The control circuit 302 includes a voltage measuring device.

In the embodiments of the present disclosure, the first voltage V1 of the OLED anode end ITO is measured when the pixel storage capacitor Cst is controlled to be charged, the second voltage V2 of the OLED anode end ITO is measured when the pixel storage capacitor Cst is controlled to be discharged; then it is determined whether the pixel storage capacitor Cst is abnormal or not according to the first voltage V1 and the second voltage V2; and if abnormity exists, production of a pixel unit corresponding to the driving circuit and other parts terminates, and a manufacturing cost is reduced.

In the present disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The present application claims the priority of the Chinese Patent Application No. 201611049648.3 filed on Nov. 24, 2016, which is incorporated herein by reference in its entirety as part of the disclosure of the present application.

The invention claimed is:

1. A method for detecting a driving circuit, comprising:

inputting a data signal, a gate line scanning signal, a voltage signal, and a first control signal with a first voltage level into a data input end, a gate scanning input end, a power source end, and a voltage sensing end of the driving circuit, respectively;

by inputting a second control signal with a second voltage level into a sensing-scanning input end of the driving circuit, controlling a pixel storage capacitor of the driving circuit to be charged, and measuring a first voltage of an organic light emitting diode (OLED) anode end of the driving circuit;

by inputting the second control signal with a third voltage level to the sensing-scanning input end, controlling the pixel storage capacitor to be discharged, and measuring a second voltage of the OLED anode end of the driving circuit; and determining whether the driving circuit has an abnormity or not according to the first voltage and the second voltage, which includes:

calculating a voltage difference between the first voltage and the second voltage; and if the voltage difference is within a preset numerical value range, determining that the driving circuit does not have the abnormity, otherwise, determining that the driving circuit has the abnormity.

2. The method according to claim 1, wherein by inputting the second control signal with the second voltage level into the sensing-scanning input end of the driving circuit, controlling the pixel storage capacitor of the driving circuit to be charged, includes:

by inputting the second control signal with the second voltage level into the sensing-scanning input end of the driving circuit, controlling the pixel storage capacitor of the driving circuit to be connected to the voltage sensing end to make the pixel storage capacitor be charged.

3. The method according to claim 1, wherein by inputting the second control signal with the third voltage level into the sensing-scanning input end, controlling the pixel storage capacitor to be discharged, includes:

by the inputting the second control signal with the third voltage level into the sensing-scanning input end, controlling the pixel storage capacitor to be disconnected from the voltage sensing end so as to make the pixel storage capacitor be discharged.

4. The method according to claim 1, wherein:

the pixel storage capacitor is controlled to be charged at a charging stage, the pixel storage capacitor is controlled to be discharged at a discharging stage, the charging stage and the discharging stage are two continuous time periods, and the charging stage is before the discharging stage.

5. The method according to claim 4, wherein a duration of the charging stage is greater than that of the discharging stage.

6. The method according to claim 4, wherein inputting the first control signal with the first voltage level to the voltage sensing end of the driving circuit, includes:

inputting the first control signal with the first voltage level to the voltage sensing end of the driving circuit at the charging stage and the discharging stage; or inputting the first control signal with the first voltage level to the voltage sensing end of the driving circuit at the charging stage.

7. The method according to claim 1, wherein the first voltage level and the second voltage level are both greater than the third voltage level.

8. The method according to claim 7, wherein the first voltage level is less than the second voltage level.

9. The method according to claim 1, wherein inputting the gate line scanning signal into the gate scanning input end of the driving circuit, includes:

controlling the pixel storage capacitor to be connected to the data input end, and causing the power source end to be disconnected from the OLED anode end.

10. The method according to claim 1, wherein a voltage value of the data signal is less than that of the gate line scanning signal.

11. The method according to claim 1, wherein a voltage value of the voltage signal is greater than or equal to 0V and less than or equal to 15V.

12. An apparatus for detecting a driving circuit, comprising:

an input circuit, configured to respectively input a data signal, a gate line scanning signal, a voltage signal, and a first control signal with a first voltage level into a data input end, a gate scanning input end, a power source end, and a voltage sensing end of the driving circuit;

a control circuit, configured to:

by inputting a second control signal with a second voltage level into a sensing-scanning input end of the driving circuit through the input circuit, control a pixel storage capacitor of the driving circuit to be charged, and measure a first voltage of an organic light emitting diode (OLED) anode end of the driving circuit; and by inputting the second control signal with a third voltage level to the sensing-scanning input end through the input circuit, control the pixel storage capacitor to be discharged, and measure a second voltage of the OLED anode end of the driving circuit; and a judgment circuit, configured to determine whether the driving circuit has an abnormity or not according to the first voltage and the second voltage at least by:

calculating a voltage difference between the first voltage and the second voltage; and if the voltage difference is within a preset numerical value range, determining that the driving circuit does not have the abnormity, otherwise, determining that the driving circuit has the abnormity.

13. The apparatus according to claim 12, wherein the control circuit controls the pixel storage capacitor of the driving circuit to be charged by inputting the second control signal with the second voltage level into the sensing-scanning input end of the driving circuit through the input circuit, including:

by inputting the second control signal with the second voltage level into the sensing-scanning input end of the driving circuit through the input circuit, controlling the pixel storage capacitor to be connected to the voltage sensing end to make the pixel storage capacitor be charged.

14. The apparatus according to claim 12, wherein the control circuit controls the pixel storage capacitor to be discharged by inputting the second control signal with the third voltage level into the sensing-scanning input end through the input circuit, including:

by inputting the second control signal with the third voltage level into the sensing-scanning input end through the input circuit, controlling the pixel storage capacitor to be disconnected from the voltage sensing end so as to make the pixel storage capacitor be discharged.

15. The apparatus according to claim 12, wherein:

the control circuit is configured to control the pixel storage capacitor to be charged at a charging stage, and to control the pixel storage capacitor to be discharged at a discharging stage, the charging stage and the discharging stage are two continuous time periods, and the charging stage is before the discharging stage.

16. The apparatus according to claim 15, wherein a duration of the charging stage is greater than that of the discharging stage.

17. The apparatus according to claim 12, wherein by inputting the gate line scanning signal into the gate scanning input end of the driving circuit, the input circuit controls the pixel storage capacitor to be connected to the data input end, and causes the power source end to be disconnected from the OLED anode end.

18. The apparatus according to claim 12, wherein the first voltage level and the second voltage level are both greater than the third voltage level.

* * * * *